US010405730B2

(12) United States Patent
Berner et al.

(10) Patent No.: US 10,405,730 B2
(45) **Date of Patent: *Sep. 10, 2019**

(54) DISHWASHER WHICH IS DESIGNED AS A BATCH DISHWASHER

(71) Applicant: ILLINOIS TOOL WORKS INC., Glenview, IL (US)

(72) Inventors: Dietrich Berner, Waldenstetten (DE); Martin Schrempp, Gengenbach (DE); Harald Disch, Elzach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/741,886

(22) PCT Filed: Jul. 19, 2016

(86) PCT No.: PCT/US2016/042887

§ 371 (c)(1),
(2) Date: Jan. 4, 2018

(87) PCT Pub. No.: WO2017/015254

PCT Pub. Date: Jan. 26, 2017

(65) Prior Publication Data

US 2018/0199792 A1 Jul. 19, 2018

(30) Foreign Application Priority Data

Jul. 22, 2015 (DE) ..... 10 2015 111 883

(51) Int. Cl.
*A47L 15/26* (2006.01)
*A47L 15/42* (2006.01)
(Continued)

(52) U.S. Cl.
CPC ..... *A47L 15/4291* (2013.01); *A47L 15/0076* (2013.01); *A47L 15/0078* (2013.01);
(Continued)

(58) Field of Classification Search
CPC .. A47L 15/0076; A47L 15/0078; A47L 15/26; A47L 15/4248; A47L 15/4278;
(Continued)

(56) References Cited

U.S. PATENT DOCUMENTS 2,947,311 A 8/1960 Fox
3,288,154 A 11/1966 Jacobs
(Continued)

FOREIGN PATENT DOCUMENTS

CN 101366619 2/2009
CN 101998839 3/2011
(Continued)

OTHER PUBLICATIONS

PCT, International Search Report and Written Opinion, International Application No. PCT/US2016/042887; dated Sep. 23, 2016, 11 pages.

*Primary Examiner* — Katelyn B Whatley
(74) *Attorney, Agent, or Firm* — Thompson Hine LLP

(57) ABSTRACT

A batch dishwasher (1) has a treatment chamber (2) with at least one wash system which is designed as a recirculation system, wherein the treatment chamber (2) has at least two treatment zones (6, 7) in which washware can be treated at the same time but independently of one another, in particular independently of one another in respect of action time, wash and/or rinse mechanics, and/or independently in respect of the selected treatment program. The at least two treatment zones (6, 7) are each realized in such a way that at least one dish rack (5) can be inserted and removed, and wherein the dishwasher (1) has a mechanism for retracting or extending
(Continued)

a dish rack (5) into at least one and, respectively, out of at least one of the at least two treatment zones (6, 7) as required.

17 Claims, 4 Drawing Sheets

(51) Int. Cl.
*A47L 15/00* (2006.01)
*A47L 15/50* (2006.01)

(52) U.S. Cl.
CPC ..... *A47L 15/26* (2013.01); *A47L 15/4248* (2013.01); *A47L 15/4278* (2013.01); *A47L 15/506* (2013.01); *A47L 15/507* (2013.01)

(58) Field of Classification Search
CPC ... A47L 15/4291; A47L 15/506; A47L 15/507
See application file for complete search history.

(56) References Cited

U.S. PATENT DOCUMENTS

| | | | |
|---|---|---|---|
| 4,134,414 | A | 1/1979 | Jarvis |
| 6,491,049 | B1 | 12/2002 | Tuller et al. |
| 8,043,437 | B1 | 10/2011 | Delgado |
| 8,394,204 | B2 | 3/2013 | Buerkle |
| 9,743,821 | B2 | 8/2017 | Baldwin |
| 2004/0007256 | A1 | 1/2004 | Durazzani |
| 2004/0244825 | A1 | 12/2004 | Ashton |
| 2007/0124004 | A1 | 5/2007 | King |
| 2008/0289655 | A1 | 11/2008 | Buerkle |
| 2011/0017235 | A1 | 1/2011 | Berner |
| 2012/0031432 | A1 | 2/2012 | Beaudet et al. |
| 2012/0138092 | A1 * | 6/2012 | Ashrafzadeh ..... A47L 15/4295 134/18 |
| 2013/0056039 | A1 | 3/2013 | Hartz |
| 2013/0269736 | A1 | 10/2013 | Baldwin |
| 2016/0113478 | A1 | 4/2016 | Disch |
| 2017/0071440 | A1 | 3/2017 | Berner |
| 2018/0206695 | A1 | 7/2018 | Disch |

FOREIGN PATENT DOCUMENTS

| | | | |
|---|---|---|---|
| DE | 2304035 | 8/1974 | |
| DE | 10004454 | 8/2001 | |
| DE | 10004454 A1 * | 8/2001 | ..... A47L 15/0084 |
| DE | 10058410 | 9/2002 | |
| DE | 10 2005 023 429 | 11/2006 | |
| DE | 60030582 | 9/2007 | |
| DE | 102006062071 | 7/2008 | |
| DE | 20 2009 004 771 | 9/2010 | |
| DE | 102011054150 | 6/2012 | |
| DE | 102011084917 | 4/2013 | |
| DE | 102013101661 | 10/2013 | |
| DE | 102012207565 | 11/2013 | |
| DE | 20 2014 010 365 | 5/2015 | |
| DE | 10 2015 203 127 | 9/2015 | |
| EP | 1790274 | 5/2007 | |
| FR | 1480946 | 5/1967 | |
| FR | 2640487 | 6/1990 | |
| GB | 1248159 | 9/1971 | |
| JP | 2000 166849 | 6/2000 | |
| JP | 2002253470 | 9/2002 | |
| WO | WO 01/93741 | 12/2001 | |
| WO | WO 2011/128804 | 10/2011 | |
| WO | WO 2013090443 | 6/2013 | |
| WO | WO 2014/186182 | 11/2014 | |
| WO | WO 2015/138545 | 9/2015 | |

* cited by examiner

DISHWASHER WHICH IS DESIGNED AS A BATCH DISHWASHER

FIELD OF THE INVENTION

The invention relates to a dishwasher in the form of a commercial utensil washer or dishwasher which is designed as a batch dishwasher.

BACKGROUND

Batch dishwashers are manually loadable and unloadable dishwashers. Batch dishwashers (also referred to as "box-type warewashers") may be a dish-rack-type pass-through dishwasher, also referred to as hood-type dishwashers ("hood-type warewashers") or front loaders ("front loader warewashers"). Front loaders may be undercounter machines, countertop machines or free-standing dishwashers with front loading configuration ("free standing front loaders").

A dishwasher in the form of a batch dishwasher normally has a treatment chamber for the cleaning of items of washware. In general, below the treatment chamber, there is arranged a wash tank into which liquid can flow back from the treatment chamber under the action of gravitational force. In the wash tank there is situated wash liquid, commonly water, to which detergents may be added if appropriate.

A dishwasher in the form of a batch dishwasher normally furthermore has a wash system with a wash pump, with a line system connected to the wash pump, and with a multiplicity of spray nozzles formed on at least one wash arm. The wash liquid situated in the wash tank can, by way of the wash pump, be delivered via the line system to the wash nozzles and sprayed through the wash nozzles in the treatment chamber onto the items of washware to be cleaned. The sprayed wash liquid subsequently flows back into the wash tank.

A dishwasher of said type in the form of a batch dishwasher is known for example from the document DE 10 2005 023 429 A1.

The expression "washware" used herein is to be understood in particular to mean dishes, glasses, cutlery, cooking utensils, baking utensils and serving trays.

The invention relates in particular to a dishwasher in the form of a commercial utensil washer or dishwasher which is designed as a batch dishwasher and is preferably realized as a front-door dishwasher, wherein the dishwasher has a treatment chamber with at least one wash system, which is designed as a recirculation system.

Dishwashers of said type are used primarily (but not exclusively) in relatively small sculleries, for example in the case of relatively small cafeterias, in particular school cafeterias, or in the catering sector. What is characteristic of the use of such dishwashers is that they are used in sculleries in which, in general, only a limited installation area is available.

A commercial dishwasher in the form of a batch dishwasher differs from a domestic dishwasher in particular in that a commercial dishwasher must be designed such that—depending on the selected treatment programme—programme running times of between one and five minutes can be realized, whereas domestic dishwashers generally have running times of up to 2.5 hours or longer. Owing to the short programme duration that is required in the case of commercial dishwashers, techniques used in domestic dishwashers generally cannot be readily transferred to commercial dishwashers.

Commercial dishwashers in the form of batch dishwashers normally operate in two main process steps: a first step, which comprises washing using a wash liquid, and a second step, which comprises final rinse using heated freshwater and dosed rinsing agent.

To be able to perform these process steps, a commercial dishwasher in the form of a batch dishwasher is generally equipped with two independent liquid systems. One liquid system is a wash water circuit which is responsible for the washing of the items of washware, wherein the washing is performed using recirculated water from the wash tank of the dishwasher. The other liquid system is a fresh water system which is responsible for the final rinse. The final rinse is performed using fresh water, preferably with fresh water from a water heater (boiler). The freshwater, after being sprayed, is likewise received in the wash tank of the dishwasher.

It is the main object of the final rinse to remove soapy water situated on the items of washware. Furthermore, the final rinse water that flows into the wash tank during the final rinse step serves for the regeneration of the wash water present in the wash tank.

Before fresh water as final rinse liquid is sprayed and is thus conducted into the wash tank of the dishwasher as a result of the final rinse process, an amount of wash liquid equivalent to the fresh water amount is pumped out of the wash tank.

Normally, commercial dishwashers in the form of batch dishwashers are equipped with multiple programmes. Said programmes differ primarily in terms of different lengths of programme running times of the washing process. The operator has the option to select a short wash programme in the case of lightly soiled items of washware or to select a correspondingly longer wash programme in the case of heavily soiled items of washware.

Commercial dishwashers which are in the form of batch dishwashers and which are designed for the batchwise loading and unloading of the treatment chamber with items of washware are in particular front-door machines or rack-type pass-through machines. In the case of front-door machines, the items of washware are placed into a rack, and the rack laden with items of washware is placed into the treatment chamber of the dishwasher through a front door and, after the cleaning process, is removed again through the front door. In the case of rack-type pass-through machines, the dish racks laden with items of washware are pushed manually into the treatment chamber from an entrance side and, after the end of a wash programme, are manually removed from the treatment chamber at an exit side. Front-door machines and rack-type pass-through machines comprise only a single treatment chamber for the treatment of the items of washware. Front-door machines may be undercounter machines or countertop machines.

Almost without exception, commercial dishwashers which are in the form of batch dishwashers and which are designed for the batchwise loading and unloading of the treatment chamber with items of washware are designed with infeed and/or run-out tables. On the infeed side of the dishwasher, it is normally the case that manual clearing and manual pre-washing of the soiled items of washware are performed. Furthermore, here, the soiled items of washware are loaded into special dish racks. The run-out side serves for the drying and unloading of the dish racks.

Commercial batch dishwashers, in particular those in the form of hood-type dishwashers, are designed for cleaning large amounts of items of washware in as short a time as possible. In the case of hood-type dishwashers that are common nowadays, the duration of a preset standard programme, which is commonly used for normally soiled items of washware such as plates, bowls, cups and glasses, is only approximately 60 to 80 seconds. This yields a theoretical capacity of up to 45 to 60 racks per hour.

Depending on the items of washware and the level of soiling thereof, it may however be necessary to select a treatment programme with a longer duration in order to ensure a flawless cleaning result.

In this context, it is known from the prior art that commercial batch dishwashers have, for example, a special cutlery treatment programme (intensive treatment program) for improving the cleaning result specifically of cutlery. Such an intensive treatment programme lasts much longer than the abovementioned 60 to 80 seconds of the standard treatment program, for example approximately 360 seconds. It is thus clear that the capacity of the machine is greatly reduced if an intensive treatment programme is selected, because the treatment chamber is then occupied for much longer than would be the case with a standard treatment program.

In practice, this has the effect that special treatment programmes, which are normally provided as standard as an alternative to the standard treatment program, are generally, despite the improved washing performance, selected only seldomly by the operator of the dishwasher because the corresponding programme duration is considered to be too long, in particular in busy periods, that is to say during periods in which increased amounts of items of washware are encountered. Instead, it is often the case that the heavily soiled items of washware (in particular cutlery and GN containers) are likewise treated using the standard treatment program, and the low washing performance is compensated for by way of additional manual working steps, for example manual prewashing of heavily soiled GN containers, or separate pre-soaking of cutlery.

In the case of relatively heavily soiled items of washware, such as commonly the case, for example, with pots or pans, it is necessary in particular for the cycle length to be correspondingly increased in order to be able to achieve a flawless cleaning result. Normally, in the case of hood-type or pass-through dishwashers, the programme running time is lengthened to up to 10 minutes in order to be able to clean heavily soiled items of washware, in particular pots and pans with burnt-on food residues, in a hygienically flawless manner.

During said lengthened cycle times, the dishwasher consequently cannot be used for cleaning less heavily soiled items of washware, such as for example plates, cups, cutlery or glasses. In other words, for the cleaning of heavily soiled items of washware, in particular pans and pots, the dishwasher is blocked for a relatively long time, which in the case of relatively small sculleries, often leads to problems, because during this time, the soiled dishes that accumulate cannot be cleaned or processed further.

In practice, it is therefore the case in particular in busy periods that the dishwasher is used only for the cleaning of lightly soiled items of washware, such as for example plates, cups and glasses, whereas the heavily soiled washware (in particular pots and pans) are manually cleaned in order to prevent the dishwasher from becoming blocked for an excessively long time owing to the required longer cycle times.

SUMMARY

Accordingly, the present invention is based on the object of further developing a commercial utensil washer or dishwasher such as is generally known in principle from the prior art, such that, even in busy periods in sculleries, no bottlenecks occur in the cleaning of the items of washware that accumulate. In particular, it is sought to specify a solution with which the working processes in sculleries can be simplified and optimized, while simultaneously saving resources (energy, water and chemicals).

It is a further object to further develop a commercial utensil washer or dishwasher, such that the capacity of the machine can be improved, even if a treatment programme is selected which leads to a longer cycle time than would be the case with a conventional standard treatment program. In particular, it is the intention here to simultaneously save resources (energy, water and chemicals).

In particular, it is sought to further develop a commercial dishwasher such that, in comparison with conventional solutions, the overall efficiency of the cleaning process can be optimized.

To achieve said objects, there is proposed in particular a dishwasher in the form of a commercial utensil washer or dishwasher which is designed as a batch dishwasher, wherein the dishwasher has a treatment chamber with at least one wash system which is designed as a recirculation system. According to the invention, the treatment chamber has a first treatment zone and at least one further, second treatment zone, wherein items of washware can be treated independently of one another and at least temporarily at the same time in the first and in the at least one second treatment zone.

In particular, it is proposed according to the invention that the at least two treatment zones of the dishwasher each be designed in such a way that at least one washing rack can be inserted and removed, wherein the dishwasher has a mechanism for moving a washing rack into or out of at least one of the at least two treatment zones as required.

By virtue of the fact that the dishwasher has a mechanism for moving a washing rack into or out of at least one of the at least two treatment zones as required, the conventionally required manual lifting and lowering of the washing racks during the loading and unloading of the dishwasher are eliminated. In this way, the physical burden placed on the operating personnel for the loading and unloading of the dish racks is significantly reduced. Furthermore, it is possible in this way for the process of loading and unloading the machine to be optimized in relation to the manual operating principle, which ultimately has an effect on the overall efficiency of the washing process.

On the other hand, through the provision of the at least two treatment zones, it is achieved that items of washware can be simultaneously treated independently of one another, in particular independently of one another with regard to action time, washing and/or rinsing mechanism, and/or independently with regard to the selected treatment program. This considerably reduces the risk, in particular during busy periods in sculleries, of bottlenecks arising in the cleaning of the items of washware that accumulate, because items of washware soiled to different extents can be treated simultaneously and independently of one another.

The expression "can be treated independently of one another" used herein is to be understood in particular to mean the treatment-zone-specific treatment of the items of washware with regard to action time, washing and/or rinsing mechanism, and/or with regard to the selected treatment program. In other words, according to the invention, provision is made for the treatment chamber to be divided into at least two zones, wherein at least some of the parameters that characterize the treatment of the items of washware (such as for example the action time, the washing/rinsing mechanism, the temperature and/or the composition of the wash liquid/final rinse liquid, etc.) can be set individually for each treatment zone.

In this context, it is conceivable for the two treatment zones to be designed to be physically, that is to say hermetically, separated from one another. This embodiment has the advantage in particular that different treatment programmes can be selected for the corresponding treatment zones of the treatment chamber. In this context, it is for example conceivable that, in one treatment zone, the items of washware are treated in accordance with a standard treatment program, whereas, in another treatment zone that is physically separate from the first treatment zone, the items of washware are treated in accordance with an intensive treatment program.

On the other hand, the present invention is not restricted to batch dishwashers in which the at least two treatment zones of the treatment chamber are physically (hermetically) separated from one another by way of a partition. According to a further aspect of the present invention, provision is rather made for the two treatment zones to be formed within a common treatment chamber, and in particular for no hermetic separation to be provided between the at least two treatment zones.

In the case of such embodiments, too, in which the at least two treatment zones are not hermetically separated from another, it is self-evidently also conceivable for the treatment of the items of washware to be performed with different action times in the different treatment zones. This is possible in particular even if one and the same treatment programme is selected for both treatment zones. In this context, it is for example conceivable that, in one of the two treatment zones, the items of washware remain in place for only one programme cycle, whereas, in the other treatment zone, the items of washware remain in place for more than one programme cycle, as a result of which the action time can be correspondingly multiplied.

In accordance with a preferred implementation of the solution according to the invention, provision is made for the at least two treatment zones to be arranged one above the other. In this context, it is expedient in particular for at least one of the at least two treatment zones, preferably each of the at least two treatment zones, to be designed to receive a washing rack, in which the items of washware for treatment in the respective treatment zone are received, in such a way that the lower region of the washing rack, on which the washing rack rests, is situated in a predefined or presettable horizontal washing plane.

In this context, it has proven to be advantageous for the dishwasher to have a (preferably a single) closable opening via which items of washware can be loaded into and unloaded from one of the at least two treatment zones, wherein the mechanism for moving a washing rack in or out as required is designed to move a washing rack which has been loaded via the opening into one treatment zone into the at least one other treatment zone.

In a preferred implementation of the dishwasher according to the invention, the mechanism for moving a washing rack in or out as required has a lifting unit with the aid of which a washing rack which is accommodated in the treatment chamber of the dishwasher can be moved from a first of the at least two treatment zones into a second treatment zone, and vice versa.

It would be conceivable in this context for the lifting unit to have a linear drive and to be designed to move the at least one washing rack from one treatment zone into the other treatment zone in a linear movement.

Alternatively or in addition to this, the mechanism for moving a washing rack in or out as required may have a pivoting unit with the aid of which a washing rack which is accommodated in the treatment chamber of the dishwasher can be moved from one of the at least two treatment zones into another of the at least two treatment zones. The pivoting unit is preferably designed to move the washing rack from one treatment zone into the other treatment zone in a superposed linear and pivoting movement.

According to a further aspect of the present invention, the dishwasher has a wash system, which is designed as a recirculation system, for spraying wash liquid in the treatment chamber as required, and has at least one final rinse system for spraying final rinse liquid in the treatment chamber as required. Furthermore, a control device is provided for the control of the at least one wash system and/or of the at least one final rinse system. Here, the control device is preferably designed to control the at least one wash system such that the wash cycle of each treatment cycle in the first treatment zone is uninterrupted in terms of time, whereas the wash cycle of a single treatment cycle in the at least one second treatment zone is intermittent. In this way, even using only a single wash pump and without the use of a valve controller, it is possible for the action times of the wash liquid in the individual treatment zones to be set to any desired values in each case.

In a refinement of the latter embodiment, it is provided in this context that the control device is furthermore designed to control the at least one wash system such that wash liquid is always sprayed simultaneously in the first and in the at least one second treatment zone.

With regard to the at least one final rinse system, provision is preferably made whereby the control device is designed to control the at least one final rinse system such that a final rinse cycle in the at least one second treatment zone always takes place simultaneously, or at least with a time overlap, with respect to a final rinse cycle in the first treatment zone. In this way, the risk of recontamination of the items of washware is minimized, which applies in particular to embodiments in which the treatment zones are not hermetically separated from one another.

In order to achieve that the dishwasher operates as efficiently as possible in terms of time, provision is made, in a preferred implementation of the dishwasher, whereby the treatment cycles in the first and in the at least one second treatment zone are adapted to one another in terms of time. For this purpose, it is conceivable, by way of the control device, for the at least one wash system to be controlled such that the time duration of a wash cycle of a single treatment cycle in the at least one second treatment zone corresponds to the total time duration of the wash cycles of a multiplicity of treatment cycles in the first treatment zone.

The expression "treatment cycle" used herein is to be understood to mean the cycle to which the respective items of washware in the corresponding treatment zone of the dishwasher are subjected before the items of washware are can be removed from the treatment zone again in the cleaned state. Normally, therefore, a treatment cycle is made up of a wash cycle and of a subsequent final rinse cycle. During a wash cycle, wash liquid is sprayed onto the items of washware, wherein, during a final rinse cycle, final rinse liquid is sprayed onto the items of washware.

Alternatively or in addition to the latter embodiment, it is conceivable, by way of the control device, for the at least one wash system to be controlled such that the time duration of a wash cycle of a single treatment cycle in the at least one second treatment zone is an integer multiple of the time duration of a wash cycle in the first treatment zone.

In a preferred refinement of the dishwasher according to the invention, the control device is furthermore designed to control the at least one wash system and/or the at least one final rinse system such that a wash cycle in the at least one second treatment zone is automatically, preferably selectively automatically, interrupted if at least one of the following conditions is met:

- a final rinse cycle is taking place in the first treatment zone; and/or
- the first treatment zone is opened or is not closed; and/or
- the second treatment zone is opened or is not closed.

In this way, the respective final rinse cycle of the individual treatment zones can be optimally adapted, which saves resources, in particular fresh water and energy.

In a refinement of the invention, to be able to achieve the most efficient possible treatment of the items of washware in the treatment zones, provision is made whereby, for the treatment zones, the treatment parameters are selected as far as possible individually and in a manner adapted to the items of washware to be cleaned.

In this context, it is conceivable for the at least one wash system to be controlled such that, during a wash cycle:

- the temperature of the wash liquid that is sprayed in the first treatment zone differs from the temperature of that in the at least one second treatment zone; and/or
- the nozzle pressure of the wash liquid that is sprayed in the first treatment zone differs from the nozzle pressure of the wash liquid that is sprayed in the at least one second treatment zone; and/or
- the amount of wash liquid that is sprayed in the first treatment zone per unit of time differs from the amount of wash liquid that is sprayed in the at least one second treatment zone per unit of time; and/or
- the detergent concentration in the wash liquid that is sprayed in the first treatment zone differs from the detergent concentration in the wash liquid that is sprayed in the at least one second treatment zone.

Alternatively or in addition to this, it is conceivable that, by way of the control device, the at least one final rinse system is controlled such that, during a final rinse cycle:

- the temperature of the final rinse liquid that is sprayed in the first treatment zone differs from the temperature of the final rinse liquid that is sprayed in the at least one second treatment zone; and/or
- the nozzle pressure of the final rinse liquid that is sprayed in the first treatment zone differs from the nozzle pressure of the final rinse liquid that is sprayed in the at least one second treatment zone; and/or
- the amount of final rinse liquid that is sprayed in the first treatment zone per unit of time differs from the amount of final rinse liquid that is sprayed in the at least one second treatment zone per unit of time; and/or
- the final rinse agent concentration in the final rinse liquid that is sprayed in the first treatment zone differs from the final rinse agent concentration in the final rinse liquid that is sprayed in the at least one second treatment zone.

The invention is directed not only to a dishwasher in which at least two treatment zones are provided in the treatment chamber of the dishwasher but also to a corresponding method for operating a dishwasher of said type.

According to the invention, the method has the following method steps:

- in the first treatment zone and in the at least one second treatment zone, wash liquid is sprayed simultaneously until the wash cycle in the first treatment zone has come to an end;
- after the end of the wash cycle in the first treatment zone, the wash cycle of the at least one second treatment zone is interrupted and final rinse liquid is sprayed in the first treatment zone; and
- the spraying of wash liquid in the at least one second treatment zone is resumed only when a further wash cycle is commenced in the first treatment zone.

According to a further aspect of the present invention, to carry out the method according to the invention, the dishwasher has a control device for controlling the at least one wash system of the dishwasher in accordance with a preset programme sequence, wherein, in the control device, there is stored at least one preset programme sequence for the first treatment zone and/or the at least one second treatment zone. In particular, in the control device, there is stored a multiplicity of preset programme sequences for the first treatment zone and/or the at least one second treatment zone, in order to enable the operator to select the most suitable treatment parameters possible.

To reduce the operating effort in the programme selection process, provision is made, in a preferred refinement of the latter embodiments, that, in the control device, there is stored at least one programme sequence group with a fixed programme sequence for the first treatment zone and a fixed programme sequence for the at least one second treatment zone.

In this context, it is conceivable in particular that the operator can optionally select one programme sequence from the multiplicity of preset programme sequences for the first treatment zone and, independently of this, can select one programme sequence from the multiplicity of preset programme sequences for the at least one second treatment zone, or can select a preset programme sequence group.

The programme sequences of the programme sequence group are preferably selected in a manner dependent on at least one of the following factors:

- a quantity of items of washware that is primarily encountered, per unit of time, in a standard situation; and/or
- the different types of items of washware that are primarily encountered, per unit of time, in a standard situation; and/or
- a level of soiling of the items of washware that is primarily encountered in a standard situation.

In a preferred implementation of the latter embodiments, provision is made whereby the programme sequence group has, for the first treatment zone, a programme sequence in which the time duration for a wash cycle of the first treatment zone amounts to 40 to 70 seconds (short program), 70 to 120 seconds (standard program) or 2 to 5 minutes (intensive program). With regard to the programme sequence for the at least one second treatment zone, provision is made here whereby, in accordance with this programme sequence, the time duration for a wash cycle in the at least one second treatment zone is identical to the time duration for a wash cycle in the first treatment zone.

Alternatively or in addition to this, it is conceivable for the programme sequence group to have, for the at least one second treatment zone, a programme sequence in which the time duration for a wash cycle in the at least one second treatment zone amounts to 40 to 70 seconds (short program), 70 to 120 seconds (standard program) or 4 to 10 minutes (intensive program).

According to a further aspect of the present invention, provision is made whereby the dishwasher has at least one user interface with at least one in particular manually or optically actuable input panel for the manual selection of at least one treatment programme for the first and/or at least one second treatment zone.

An "manually actuable input panel" is to be understood in particular to be a keyboard or the like, whereas an "optically actuable input panel" is an input panel which can be actuated by radio, IR, WLAN or a similar wireless communication connection.

Here, in accordance with a preferred implementation, provision is made whereby a common user interface is provided for the first and at least one second treatment zone. Said common user interface is preferably arranged in the upper region of the vertical pivotable or slidable hood by way of which the first treatment zone can be closed. In this way, it is ensured that the operator of the machine can manually actuate the input panel only when the first treatment zone is closed.

As an alternative to this, it is however self-evidently also conceivable for in each case one user interface to be provided for the first and at least one second treatment zone.

In a preferred implementation of the invention, provision is made whereby the at least one user interface is designed for outputting, preferably by optical and/or acoustic means, information regarding a system state of the dishwasher.

Alternatively or in addition, it is conceivable for the at least one user interface to have at least one in particular optical or manually actuable input panel, in particular keyboard, for manual intervention into a treatment cycle of the first treatment zone and/or into a treatment cycle of the at least one second treatment zone.

In this context, it is furthermore conceivable for the at least one user interface to have a first manually actuable input panel, in particular keyboard, for starting and/or ending a treatment cycle in the first and/or at least one second treatment zone, and a second, in particular manually or optically actuable input panel which is formed separately from the first input panel and which serves for the accessing of information relating to a system state of the dishwasher and/or for manual intervention into a treatment cycle of the first and/or at least one second treatment zone and/or for the accessing and/or selection of programme parameters for the first and/or at least one second treatment zone.

BRIEF DESCRIPTION OF THE DRAWINGS

Below, the invention will be described in more detail with reference to the exemplary embodiment illustrated in the drawings, in which.

DETAILED DESCRIPTION

Figure 1A:
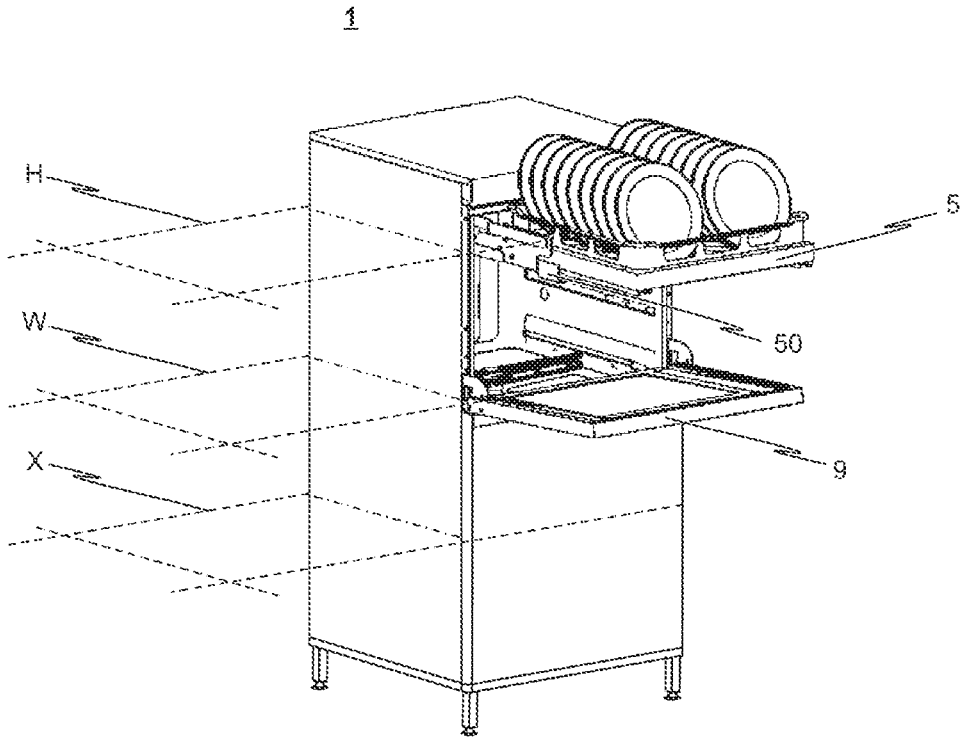
FIG. 1*a* is a perspective illustration of an exemplary embodiment of the dishwasher according to the invention in a first functional state, in which a washing rack has been moved fully out of the treatment chamber of the dishwasher.

The invention relates to commercial dishwashers, in particular dishwashers or utensil washers, in the form of batch dishwashers.

A commercial dishwasher 1 designed as a batch dishwasher has, as is conventional, a programme control device (also referred to here as "control device 100") for the control of at least one cleaning program, and has a treatment chamber 2, which can be closed by way of at least one door 9, in a machine housing for receiving items of washware to be cleaned, such as for example dishes, cutlery, pots, pans, trays and glasses.

The action time, that is to say the time during which the cleaning or wash liquid wets the items of washware within the treatment chamber 2 is dependent in particular on the duration of the wash phase defined by way of the treatment program. For normally soiled items of washware, such as plates, bowls, cups and/or glasses, a cleaning cycle composed of a wash phase and of a subsequent final rinse phase generally requires between 50 and 100 seconds. However, longer treatment of the items of washware may be necessary, in particular if these are relatively heavily soiled, or if dirt has burned onto the items of washware. Lengthening of the overall treatment time to up to 400 seconds is then often necessary. As a result of the lengthened action time, the items of washware to be cleaned are subjected to intensive treatment, such that even relatively heavily soiled items of washware can be effectively cleaned.

To ensure that, despite an intensive treatment, the cleaning capacity of the dishwasher 1, that is to say the items of washware/washware racks 5 that can theoretically be processed by the machine 1 per unit of time, is not adversely affected, provision is made, according to the invention, for the treatment chamber 2 of the dishwasher 1, which is designed as a batch dishwasher, to be divided into at least two treatment zones 6, 7, wherein the at least two treatment zones 6, 7 are designed such that the treatment of the items of washware in the individual treatment zones 6, 7 can be performed independently of one another.

Even though the exemplary embodiments of the dishwasher 1 according to the invention illustrated in the drawings are each formed with precisely two treatment zones 6, 7, this is not to be regarded as being restrictive. Rather, it is self-evidently also conceivable for the treatment chamber 2 of the dishwasher 1 according to the invention to be divided into more than two zones.

As illustrated by way of example in FIGS. 1*a* and 1*b*, an exemplary embodiment of the present invention relates to a dishwasher 1 which is designed as a front-door machine and which is distinguished by the fact that, in addition to the (main) treatment zone 6 that is provided in the conventional manner, a further treatment zone 7 is formed, which is arranged below the former treatment zone 6. The dishwasher 1, which is designed as a front-door machine, is furthermore distinguished by the fact that it is equipped only with a single door 9, via which both the items of washware to be treated in the upper treatment zone 6 and the items of washware to be treated in the lower treatment zone 7 of the dishwasher 1 can be introduced into the treatment chamber 2.

The upper, main treatment zone 6, which is herein also referred to as "first treatment zone", is designed to receive a washing rack 5 which is possibly laden with the items of washware to be treated.

For this purpose, the footprint of the first treatment zone or main treatment zone 6 has dimensions adapted to the footprint of a washing rack 5, and in particular a footprint of 600 mm×500 mm, 500 mm×500 mm, or 400 mm×400 mm.

Furthermore, in this regard, the dishwasher 1 is equipped with a mechanism for moving a washing rack 5 into or out of at least one of the at least two treatment zones 6, 7 as required. Said mechanism makes it possible for the two treatment zones 6, 7 of the dishwasher 1 to be loaded and unloaded with items of washware in batchwise fashion via a single loading and unloading opening formed in the machine housing.

Figure 1B:
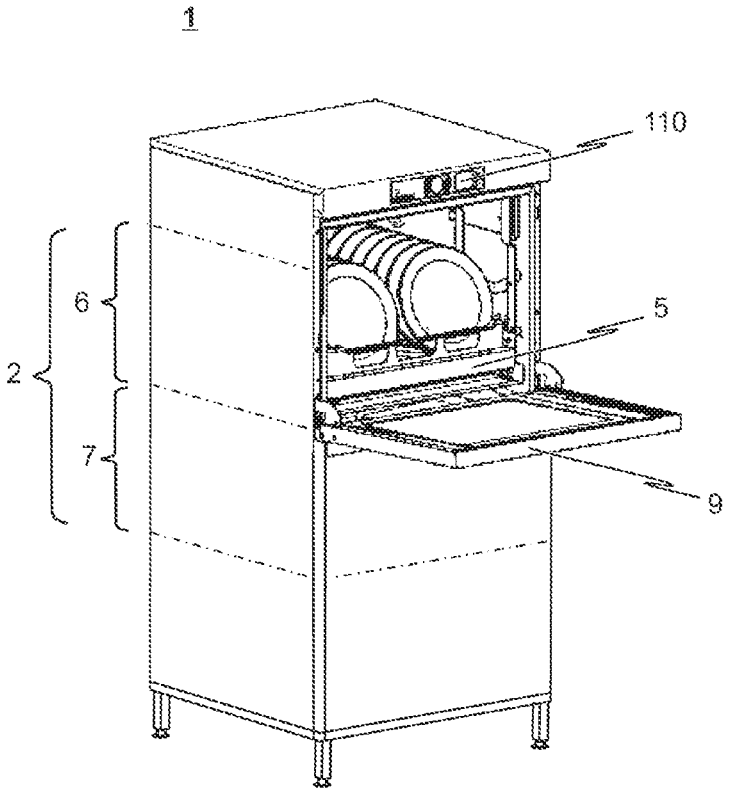
FIG. 1*b* is a perspective illustration of the dishwasher shown in FIG. 1*a*, in a second state in which the washing rack has been moved into a first treatment zone of the treatment chamber.

As indicated in FIGS. 1*a* and 1*b*, it is the case here that the items of washware are preferably arranged in a washing rack 5. One of the two treatment zones 6, 7 (in this case the upper treatment zone 6) may have one or more rack receptacles or rack holding frames, for example, as illustrated, a single rack receptacle/a single rack holding frame 50, on which in each case one washing rack 5 can be or is positioned. Alternatively to this, it is for example also possible for multiple rack receptacles/rack holding frames, in particular two rack receptacles/rack holding frames arranged one above the other, to be provided.

In the exemplary embodiment of the dishwasher 1 according to the invention illustrated in FIGS. 1*a* and 1*b*, the mechanism for moving the washing rack in or out as required has a pivoting unit with the aid of which a washing rack 5 accommodated in the upper treatment zone 6 of the treatment chamber 2 (cf. FIG. 1*b*) can be transferred from the washing plane W of the upper treatment zone 6 into a plane H above the washing plane W (cf. FIG. 1*a*) and vice versa.

Specifically, and as shown by a juxtaposition of FIGS. 1*a* and 1*b*, it is provided in the exemplary embodiment of the dishwasher 1 according to the invention illustrated in the drawings that the pivoting unit is designed to move the washing rack 5 from the washing plane W into the plane H above the washing plane W (cf. FIG. 1*a*) and vice versa preferably in a superposed linear and pivoting movement.

For this purpose, in an exemplary embodiment, as a pivoting unit, use is made of a simple four-bar linkage, wherein the rack-holding frame 50 of the dishwasher 1, which rack-holding frame serves for receiving and holding a washing rack 5 in the treatment chamber 2, is connected to the machine housing at both sides by way of in each case two parallel-running articulated connections.

Here, it is advantageous if the pivoting unit is connected to the rack-holding frame 50 such that, in the fully pivoted-out state (cf. FIG. 1*a*), the washing rack 5 is situated in a horizontal plane which is aligned with or otherwise proximate to the top side of the machine housing 2 of the dishwasher 1. It is then possible for the operating personnel to transfer the washing rack 5 out of the rack-holding frame 6 onto the top side of the machine without the need for the washing rack 5 to be lifted.

In the exemplary embodiment of the dishwasher 1 according to the invention illustrated in FIGS. 1*a* and 1*b*, the mechanism for moving the washing rack in or out as required furthermore has a lifting unit with a linear drive to enable a washing rack 5 accommodated in the upper treatment zone 6 of the treatment chamber 2 (cf. FIG. 1*b*) to be moved from the washing plane W of the upper treatment zone 6 into a washing plane X of the lower treatment zone 7 below the washing plane W (cf. FIG. 1*a*).

Specifically, the linear drive of the lifting unit is designed such that, in the operating situation illustrated for example in FIG. 1*b*, said linear drive lowers the washing rack 5 once again in a linear movement and brings said washing rack to the level of the washing plane X of the lower treatment zone 7.

As already indicated, a further treatment zone 7 is formed below the main treatment zone 6. Said further treatment zone 7, which will hereinafter also be referred to as "second treatment zone" or "auxiliary treatment zone", serves in particular for the cleaning of items of washware which require a relatively long action time in relation to the items of washware to be cleaned in the first treatment zone 6.

In the case of the exemplary embodiment illustrated in FIGS. 1*a* and 1*b*, the second treatment zone 7 is likewise designed to receive a washing rack 5, wherein the items of washware to be treated in the further treatment zone 7 are received in the washing rack 5.

Specifically, the dimensions and cleaning capacity of the main treatment zone (first treatment zone 6) and the dimensions and cleaning capacity of the auxiliary treatment zone (second treatment zone 7) are preferably adapted to the washware types (such as for example dishes, cutlery, glasses and pots) which are commonly encountered in sculleries and which are to be cleaned, to the quantities of items of washware to be cleaned, of each washware type, that are commonly encountered per unit of time, and/or to the level of soiling of the items of washware that are encountered per unit of time, in such a way that, during the operation of the dishwasher 1, all of the items of washware that accumulate can be cleaned as far as possible without delay, even during busy periods.

Therefore, in the embodiment of the dishwasher 1 according to the invention shown in FIGS. 1*a* and 1*b*, provision is made whereby the first treatment zone 6 has an effectively usable loading volume for the cleaning of items of washware which is 2 to 4 times greater than the effectively usable loading volume of the second treatment zone 7. Specifically, here, the effectively usable loading volume of the first treatment zone 6 amounts to between 60 and 180 litres, and preferably between 80 and 150 litres, and is even more preferably approximately 120 litres, whereas the effectively usable loading volume of the second treatment zone 7 amounts to a loading volume of between 25 and 75 litres and preferably between 30 and 50 litres. It is ensured in this way that, even during busy periods in sculleries, even relatively heavily soiled items of washware can be effectively cleaned in a short period of time.

The external dimensions of the dishwasher 1 according to the invention are similar to those of a conventional machine of similar type which has only a single treatment zone, wherein, however, with the dishwasher according to the invention, the machine capacity is increased, with relatively reduced consumption of resources.

In order, for example, to clean the items of washware that accumulate in the case of a total of 150 menu options, a conventional dishwasher which has only a single treatment zone requires a total of 67 minutes, with fresh water consumption of 100 litres and energy consumption of 2.9 kWh (in the case of a standard treatment program).

By contrast, with the dishwasher 1 according to the invention, the treatment duration can be reduced to below 50 minutes, specifically with fresh water consumption of 72.5 litres and energy consumption of 2.1 kWh.

Below, with reference to the hydraulic diagram in FIG. 2, a description will be given of the functioning of the wash/final rinse systems that are used for example in a dishwasher 1, designed as a batch dishwasher, according to the present invention.

Although it is basically conceivable for the dishwasher 1 according to the present invention to be equipped with multiple wash tanks, wherein in each case one wash tank is assigned to one treatment zone 6, 7, provision is made, in the preferred exemplary embodiments of the solution according to the invention illustrated in the drawings, whereby the dishwasher 1 has in each case only a single wash tank 12 which is assigned to the (single) treatment chamber 2 and which is thus assigned jointly to the individual treatment zones 6, 7 of the (single) treatment chamber 2.

The wash tank 12 preferably has a capacity of 20 to 40 litres, preferably 25 to 35 litres. This capacity is firstly sufficient for simultaneous final rinse operation in both treatment zones 6, 7. Secondly, the tank 12 is selected to be so small that it can, as before, be accommodated in the reduced installation space—in relation to a conventional machine which has only a single treatment zone—in the machine housing.

As illustrated in the hydraulic diagram in FIG. 2, the (single) wash tank 12 is situated below the treatment chamber 2 of the machine 1 and serves for receiving liquid that has been sprayed in the respective treatment zones 6, 7 of the treatment chamber 2.

As already indicated, in the embodiments illustrated in the drawings, provision is made whereby the treatment chamber 2 of the dishwasher 1 is divided into a total of two treatment zones 6, 7, specifically a main treatment zone 6 and an auxiliary treatment zone 7. The treatment zones 6, 7, which are integrated within the (single) treatment chamber 2, are assigned a common wash system.

Figure 2:
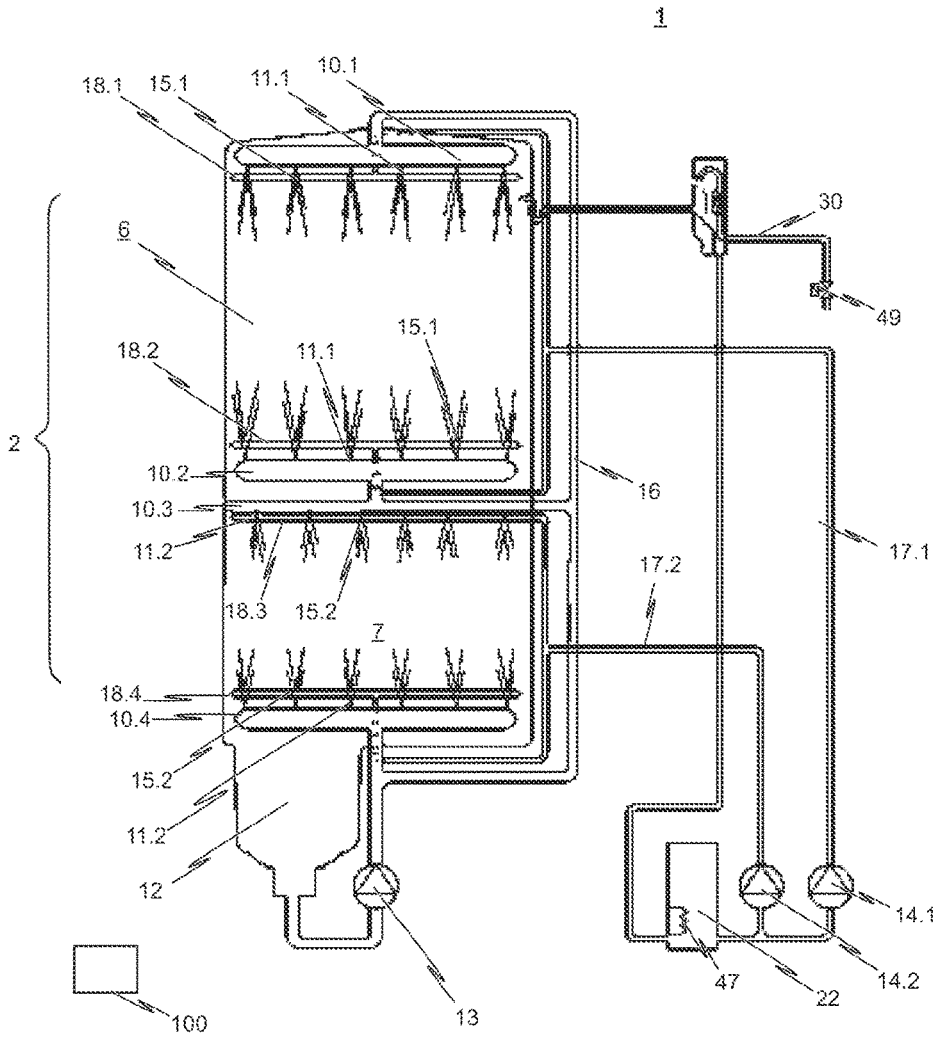
FIG. 2 schematically shows a hydraulic diagram of a wash system of a dishwasher, designed as a batch dishwasher, according to an embodiment of the present invention.

In the hydraulic diagram illustrated in FIG. 2, the wash system has a (common) wash pump 13 by way of which wash liquid can be delivered from the wash tank 12 through a wash liquid line system to corresponding wash nozzles 11.1, 11.2.

In the embodiment schematically illustrated in FIG. 2, the wash nozzles 11.1, 11.2 are integrated into corresponding wash arms 10.1, 10.2, 10.3, 10.4. Here, provision is made whereby the upper (main) treatment zone 6 is assigned a first wash arm arrangement composed of an upper wash arm 10.1 and a lower wash arm 10.2. The lower (auxiliary) treatment zone 7 is assigned a further wash arm arrangement, which likewise has an upper wash arm 10.3 and a lower wash arm 10.4.

In the hydraulic diagram shown in FIG. 2, the lower wash arm 10.2 of the main treatment zone 6 and the upper wash arm 10.3 of the auxiliary treatment zone 7 are designed as laterally arranged wash arms in order to allow a washing rack 5 to be transferred from the upper treatment zone 6 into the lower treatment zone 7 (and vice versa).

The wash nozzles 11.1, 11.2 integrated into the corresponding wash arms 10.1 to 10.4 are directed in each case toward the correspondingly associated treatment zone 6, 7 in the treatment chamber 2 and serve to spray the wash liquid, which is delivered by the common wash pump 13, onto the items of washware which are arranged in the respective treatment zones 6, 7 and which are to be cleaned.

The sprayed wash liquid falls back into the wash tank 12 under the action of gravitational force. In this way, the wash tank 12, the wash pump 13, the wash liquid system 16 and the wash nozzles 11, together with the treatment zones 6, 7 of the treatment chamber 2, form a wash liquid circuit. The wash liquid line system 16 connects the pressure side of the wash pump 13 to the wash nozzles 11.1, 11.2.

In the embodiment of the dishwasher 1 according to the invention schematically illustrated in FIG. 2, provision is also made of a final rinse system for the delivery of final rinse liquid by way of final rinse pumps 14.1, 14.2 through corresponding final rinse line systems 17.1, 17.2 to final rinse nozzles 15.1, 15.2, which final rinse nozzles are directed, in the treatment chamber 2, in each case in the treatment zones 6, 7, toward the region of the items of washware to be treated.

In this case, provision is made, in particular, whereby the upper treatment zone 6 is assigned a dedicated final rinse system composed of a dedicated final rinse pump 14.1 and a dedicated final rinse line system 17.1. In the same way, the lower treatment zone 7 is assigned a dedicated final rinse system composed of a dedicated final rinse pump 14.2 and a dedicated final rinse line system 17.2. Here, the two final rinse pumps 14.1, 14.2 can be controlled by a control device 100, which is merely schematically indicated in FIG. 2.

The upper treatment zone 6 is assigned corresponding final rinse nozzles 15.1, to which, during a final rinse phase, fresh water or fresh water with dosed final rinse agent is supplied by way of the final rinse pump 14.1.

Before final rinse liquid is sprayed during the final rinse phase, an amount of wash liquid equivalent to the final rinse liquid amount is in each case pumped out of the wash tank 12 by way of a discharge pump (not illustrated in the drawings), the suction side of which is connected via a discharge line to a sump of the wash tank 12. If, before an initial start of the dishwasher 1 which is designed as a batch dishwasher, the wash tank 12 is empty, it must firstly be filled with fresh water via a fresh water line (not shown), or filled with fresh water, or some other final rinse liquid or wash liquid, by way of the final rinse systems and the final rinse pumps 14.1, 14.2 thereof.

The final rinse liquid may be fresh water or fresh water mixed with final rinse agent. By contrast, the wash liquid comprises detergent which is dosed preferably automatically to the liquid contained in the wash tank 12 by a detergent dosing device (not shown). The abovementioned programme control device controls the wash pumps 13, the final rinse pumps 14.1, 14.2, the drainage pump and the detergent solution pump (not shown) in a manner dependent on the cleaning programme respectively selected by an operator by way of the programme control device. At least one cleaning programme is provided; it is preferable for multiple selectable cleaning programmes to be provided.

From the hydraulic diagrams illustrated in the drawings, it can be seen that, in each case, the final rinse pumps 14.1, 14.2 are connected by way of their suction sides to an outlet of a boiler 22. The boiler 22 furthermore has an inlet which is connected to a fresh water supply line 30, via which either fresh water, or fresh water with dosed final rinse agent, is supplied to the boiler 22. In the boiler 22, the liquid (pure fresh water or fresh water with dosed final rinse agent) supplied via the inlet is heated up in accordance with a process sequence. By way of the final rinse pumps 14.1, 14.2, which are connected by way of their suction sides to the boiler outlet, the final rinse liquid that is heated up in the boiler 22 can be supplied, for example during a fresh water final rinse phase, via one of the final rinse line systems 17.1, 17.2 to the final rinse nozzles 15.1 and 15.2. The final rinse nozzles 15.1 and 15.2 are arranged in the treatment zones 6, 7 of the treatment chamber 2 in order to spray the final rinse liquid, which has been heated up in the boiler 22, onto the items of washware in the corresponding treatment zone 6, 7 of the treatment chamber 2.

It is self-evidently also conceivable for the boiler 22 to be supplied with pure fresh water via the inlet into the fresh water supply line 30, which pure fresh water has a final rinse agent dosed into it after the heating process in the boiler 22.

Also, in this context, it is conceivable for the final rinse system to have a preferably electrically operated steam generator, which may for example be integrated into the boiler 22. In this case, at the upper region of the boiler 22, there may be formed a corresponding steam outlet of the steam generator (not illustrated in the drawings). Via a steam line, the steam outlet of the steam generator may be connected, at a position situated above the wash tank, to the treatment chamber in order to introduce steam, which has been generated in the steam generator, into said treatment chamber as required. Other positions are however self-evidently also possible.

In the boiler 22, which according to some embodiments of the invention serves not only for heating the final rinse liquid but also for the generation of steam as required, there is situated a heater 47. Furthermore, in or at the boiler 22, there may be arranged a level sensor which, for example, controls a valve 49 of the fresh water line 30.

The control device 100 that is merely schematically indicated in FIG. 2 serves for the control of the correspondingly controllable components of the wash and/or final rinse system of the dishwasher 1. In particular, the control device 100 is designed to control the preferably common wash pump 13 of the wash system such that the wash cycle of each treatment cycle in the first treatment zone 6 is uninterrupted in terms of time, whereas the wash cycle of a single treatment cycle in the second treatment zone 7 is intermittent.

Furthermore, in the exemplary embodiments of the dishwasher 1 according to the invention illustrated in the drawings, the control device 100 is furthermore designed to control the preferably common wash pump 13 such that wash liquid is always sprayed simultaneously in the first and in the second treatment zone 6, 7.

With regard to the final rinse system of the dishwasher 1, the control device 100 is designed to control the two final rinse pumps 14.1, 14.2 such that a final rinse cycle in the second treatment zone 7 always takes place simultaneously, or at least with a time overlap, with respect to a final rinse cycle in the first treatment zone 6.

Here, it is advantageous if the control device 100 is furthermore designed to control the preferably common wash pump 13 such that the time duration of a wash cycle of a single treatment cycle in the second treatment zone 7 corresponds to the total time duration of the wash cycles of a multiplicity of treatment cycles in the first treatment zone 6. In particular, in this context, it is conceivable that, by way of the control device 100, the preferably common wash pump 13 is controlled such that the time duration of a wash cycle of a single treatment cycle in the second treatment zone 7 is an integer multiple of the time duration of a wash cycle in the first treatment zone 6.

In the embodiments of the dishwasher 1 according to the invention illustrated in the drawings, provision is basically made for the control device 100 to be designed to control the at least one wash system and/or the at least one final rinse system such that a wash cycle in the second treatment zone 7 is automatically, preferably selectively automatically, interrupted if at least one of the following conditions is met:

- a final rinse cycle is taking place in the first treatment zone 6; and/or
- the first treatment zone 6 is opened or is not closed, which can be detected for example by way of a corresponding sensor; and/or
- the second treatment zone 7 is opened or is not closed, which can likewise be detected for example by way of a corresponding sensor.

The control of the wash system and/or final rinse system is preferably performed automatically. In other words, the control of the at least one wash and/or final rinse system is preferably performed in accordance with a preset programme sequence, wherein, in the control device 100, there is stored at least one preset programme sequence for the first treatment zone 6 and/or the at least one second treatment zone 7. It is preferable for a multiplicity of preset programme sequences for the first treatment zone 6 and/or the at least one second treatment zone 7 to be stored in the control device 100.

In this context, it is conceivable that, in the control device 100, there is stored at least one programme sequence group with a fixed programme sequence for the first treatment zone 6 and a fixed programme sequence for the at least one second treatment zone 7. Here, the operator of the dishwasher 1 can optionally select one programme sequence from the multiplicity of preset programme sequences for the first treatment zone 6 and, independently of this, can select one programme sequence from the multiplicity of preset programme sequences for the at least one second treatment zone 7, or can select a preset programme sequence group.

It is advantageously the case that, in the control device 100, there is stored at least one programme sequence group with a fixed programme sequence for the first treatment zone 6 and a fixed programme sequence for the at least one second treatment zone 7, and wherein the programme sequences of the programme sequence group are selected in a manner dependent on at least one of the following factors:

- a quantity of items of washware that is primarily encountered, per unit of time, in a standard situation; and/or
- the different types of items of washware that are primarily encountered, per unit of time, in a standard situation; and/or
- a level of soiling of the items of washware that is primarily encountered in a standard situation.

It is furthermore preferable if, in the control device 100, there is stored at least one programme sequence group with a fixed programme sequence for the first treatment zone 6 and a fixed programme sequence for the at least one second treatment zone 7, wherein the programme sequence group has, for the first treatment zone 6, a programme sequence in which the time duration for a wash cycle of the first treatment zone amounts to 40 to 70 seconds, 70 to 120 seconds or 2 to 5 minutes, and wherein the programme sequence group has, for the at least one second treatment zone 7, a programme sequence in which the time duration for a wash cycle in the second treatment zone 7 is identical to the time duration for a wash cycle in the first treatment zone 6.

On the other hand, it is preferable if, in the control device 100, there is stored at least one programme sequence group with a fixed programme sequence for the first treatment zone 6 and a fixed programme sequence for the at least one second treatment zone 7, wherein the programme sequence group has, for the first treatment zone 6, a programme sequence in which the time duration for a wash cycle of the first treatment zone amounts to 40 to 70 seconds, 70 to 120 seconds or 2 to 5 minutes, and wherein the programme sequence group has, for the at least one second treatment zone 7, a programme sequence in which the time duration for a wash cycle in the second treatment zone amounts to 40 to 70 seconds, 70 to 120 seconds or 4 to 10 minutes.

Below, with reference to the illustration in FIG. 3, a description will be given of an exemplary embodiment of a user interface 110 by way of which an operator of the dishwasher 1 according to the invention can select at least one treatment programme or corresponding treatment parameters for the first and/or second treatment zone 6, 7.

Figure 3:
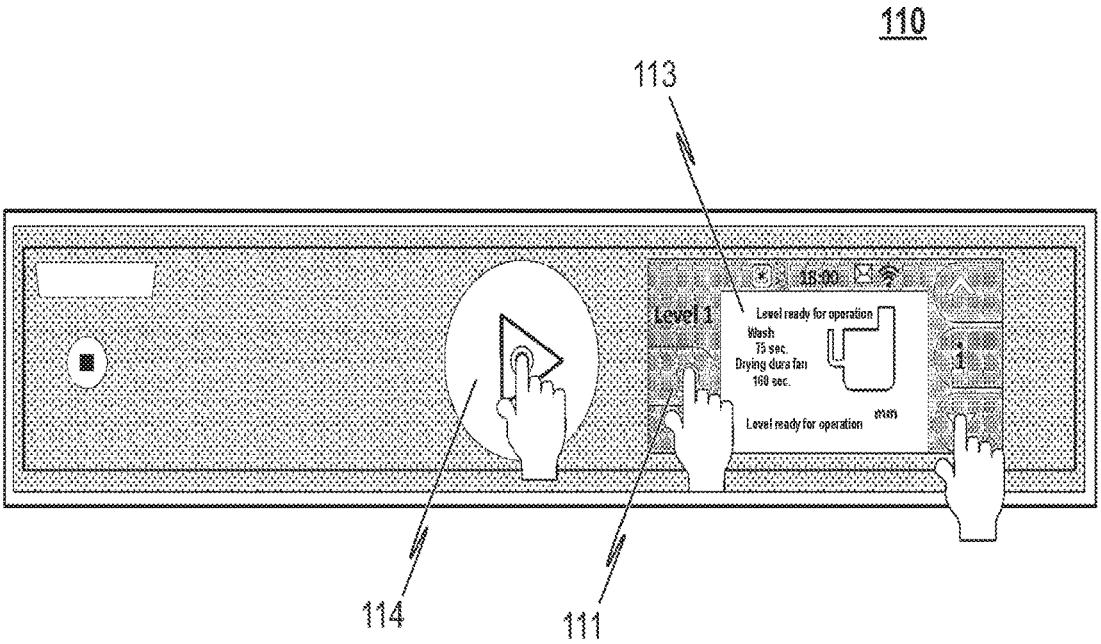
FIG. 3 shows an embodiment of a user interface for the dishwasher according to the invention.

Specifically, the embodiment of the user interface 110 illustrated in FIG. 3 is designed as a common user interface for both treatment zones 6, 7 of the dishwasher 1. As emerges from the illustrations in FIGS. 1*a* and 1*b*, said common user interface 110 is arranged in the upper region of the machine 1 above the common door.

The present invention is self-evidently not restricted to embodiments in which a common user interface 110 is used for all treatment zones 6, 7 of the dishwasher 1. In particular, it is conceivable for in each case one user interface to be provided for the first and at least one second treatment zones 6, 7.

As indicated in FIG. 3, the user interface 110 is designed to provide information regarding a system state of the dishwasher 1. In the illustration of FIG. 3, this is realized optically by way of a corresponding information panel 113.

Furthermore, the user interface 110 is equipped with an input panel 111 in order to enable the user to manually intervene in a treatment cycle of the first treatment zone 6 and/or in a treatment cycle of the at least one second treatment zone 7.

In particular, the user interface 110 schematically illustrated in FIG. 3 is equipped with a first, manually actuable input panel 114, for the purposes of starting or ending a treatment cycle in the first and/or at least one second treatment zone 7, and with a second input panel 111, which is formed separately from the first input panel 114 and which serves the purposes of accessing information relating to a system state of the dishwasher 1 and/or intervening in a treatment cycle of the first and/or at least one second treatment zone 7, and/or accessing or selecting programme parameters for the first and/or at least one second treatment zone 7.

In summary, it is accordingly evident that the solution according to the invention provides at least one additional treatment zone 7, specifically in particular for items of washware, such as cutlery or GN containers, which are generally relatively heavily soiled and which thus require a relatively long washing duration. In this way, the washing performance can be improved by virtue of the programme duration of the additional treatment zone 7 being lengthened, specifically to the extent required for the type of washware to be treated in said treatment zone 7 in order to ensure a flawless washing result. In addition to this, despite the use of the intensive programme in the additional treatment zone 7, the capacity of the main wash zone 6 is not adversely affected, that is to say is not reduced.

For example, by way of the main treatment zone 6, it is possible for five racks to be treated using a standard treatment programme while, furthermore, in the lower or additional treatment zone 7, one rack is treated simultaneously, that is to say in parallel therewith, using an intensive treatment program.

It is thus possible for the existing treatment zone 6 to be operated without capacity losses for the normally soiled items of washware in relation to current machines, specifically with a simultaneous improvement of the washing result for relatively heavily soiled items of washware, because these can be cleaned in parallel therewith in the additional treatment zone 7, for example using a special intensive treatment program.

The invention is not restricted to the exemplary embodiments that are illustrated purely by way of example in the drawings, but rather emerges from an overall view of all of the features and aspects disclosed herein.

The invention claimed is:

1. A batch dishwasher, comprising:

a treatment chamber with at least one wash system which is designed as a recirculation system, wherein the treatment chamber includes a first treatment zone and a second treatment zone, wherein the first treatment zone and the second treatment zone are arranged with the first treatment zone above the second treatment zone, wherein the first treatment zone and the second treatment zone are configured such that items of washware are treatable at the same time but independently of one another in respect of one or more of action time, wash mechanics, rinse mechanics, or selected treatment program, wherein a single opening to the treatment chamber enables at least one dish rack to be inserted into and removed from each of the first treatment zone and the second treatment zone, wherein the single opening is vertically aligned with the first treatment zone and located vertically higher than the second treatment zone, wherein the single opening can be closed by a single door, wherein the second treatment zone is located lower than the single opening such that, in order to load a given dish rack into a rack wash position within the second treatment zone, the given dish rack is moved through the single opening, into the first treatment zone and then downward out of the first treatment zone and into the second treatment zone, and wherein the dishwasher has a mechanism for retracting or extending a dish rack into and out of at least one of the first treatment zone or the second treatment zone.

2. The dishwasher as claimed in claim 1, wherein the mechanism for retracting or extending a dish rack includes a lifting unit for moving the given dish rack that is loaded in the rack wash position of the second treatment zone vertically upward into the first treatment zone so that the given dish rack is aligned with the single opening for removal.

3. The dishwasher as claimed in claim 2, wherein the lifting unit has a linear drive to move the given dish rack vertically upward from the second treatment zone into the first treatment zone with a linear movement.

4. The dishwasher as claimed in claim 1, wherein the mechanism for retracting or extending a dish rack has a pivoting unit with the aid of which the given dish rack, which is accommodated in the rack wash position of the second treatment zone, can be moved from the second treatment zone up into the first treatment zone.

5. The dishwasher as claimed in claim 4, wherein the pivoting unit is designed to move the dish rack with a superimposed linear and pivoting movement.

6. The dishwasher as claimed in claim 1, wherein the mechanism for retracting or extending a dish rack has an electrical, pneumatic or hydraulic drive, for automatically retracting or extending the at least one dish rack.

7. The dishwasher as claimed in claim 1, wherein the at least one wash system has a nozzle system with at least one wash nozzle for spraying wash liquid onto the washware which is accommodated in the first and second treatment zones of the treatment chamber.

8. The dishwasher as claimed in claim 7, wherein the nozzle system has at least one first wash arm which is associated with the first treatment zone, and has at least one second wash arm which is associated with the second treatment zone.

9. The dishwasher as claimed in claim 8, wherein the nozzle system further has a common wash arm which is associated with both the first treatment zone and the second treatment zone.

10. The dishwasher as claimed in claim 9, wherein wash and/or rinse nozzles are in each case formed in the respective wash arms.

11. The dishwasher as claimed in claim 7, wherein the dishwasher has a wash tank for collecting at least some of the liquid which is sprayed by the nozzle system into the first and second treatment zones of the treatment chamber.

12. The dishwasher as claimed in claim 11, wherein the at least one wash system is realized as a wash system which is common to the first and second treatment zones, and has a common wash pump for supplying wash liquid, which is collected in the wash tank, to the nozzle system.

13. A batch dishwasher, comprising:

a treatment chamber with at least one wash system which is configured as a recirculation system, wherein the treatment chamber includes a first treatment zone and a second treatment zone in which washware can be treated at the same time but independently of one another, wherein the first treatment zone is arranged above the second treatment zone, wherein a single opening to the treatment chamber enables a dish rack to be inserted into and removed from the second treatment zone, wherein the single opening is located in vertical alignment with the first treatment zone and is located vertically higher than the second treatment zone, wherein the single opening can be closed by a single door, wherein the second treatment zone is located lower than the single opening such that, in order to load a dish rack into a rack wash position within the second treatment zone, the dish rack is moved through the single opening, into the first treatment zone and then downward out of the first treatment zone and into the second treatment zone, and wherein the dishwasher has a mechanism for retracting or extending a dish rack into at least the first treatment zone.

14. The batch dishwasher as claimed in claim 13, wherein the mechanism for retracting or extending a dish rack moves in part through the opening and is further configured to move a dish rack which has been loaded into the first treatment zone down into the second treatment zone.

15. The batch dishwasher as claimed in claim 13, wherein the mechanism for retracting or extending a dish rack has a lifting unit operable such that a dish rack within the treatment chamber can be moved vertically from the first treatment zone to the second treatment zone, and vice versa.

16. The batch dishwasher as claimed in claim 13, wherein the mechanism for retracting or extending a dish rack has a pivoting unit with the aid of which a dish rack which is within the first treatment zone can be moved out of the first treatment zone into a position proximate to a top side of a housing of the dishwasher.

17. A batch dishwasher, comprising:

a treatment chamber with at least one wash system which is configured as a recirculation system, wherein the treatment chamber includes a first treatment zone and a second treatment zone in which washware can be treated at the same time but independently of one another, wherein the first treatment zone is arranged above the second treatment zone, wherein a common opening to the treatment chamber provides access to both the first treatment zone and the second treatment zone for rack insertion and removal of dish racks, wherein the common opening is located in vertical alignment with the first treatment zone and is located vertically higher than the second treatment zone, wherein the first treatment zone includes a first rack wash position at which a dish rack is positionable for washing and the second treatment zone includes a second rack wash position at which a dish rack is positionable for washing, wherein the second rack wash position is below the first rack wash position, wherein a dish rack loaded into the second rack wash position must move upward through the first rack wash position in order to reach the common opening for removal from the treatment chamber, and wherein the dishwasher has a mechanism for retracting or extending a dish rack into at least the first treatment zone, wherein the dishwasher further includes a single door for selectively closing the common opening.

* * * * *